US009037052B2

(12) United States Patent
Taguchi et al.

(10) Patent No.: US 9,037,052 B2
(45) Date of Patent: May 19, 2015

(54) DEVELOPER SUPPLY DEVICE

(71) Applicants: Kazuna Taguchi, Aichi (JP); Keisuke Takahashi, Aichi (JP)

(72) Inventors: Kazuna Taguchi, Aichi (JP); Keisuke Takahashi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 102 days.

(21) Appl. No.: 13/747,958

(22) Filed: Jan. 23, 2013

(65) Prior Publication Data

US 2013/0188995 A1 Jul. 25, 2013

(30) Foreign Application Priority Data

Jan. 23, 2012 (JP) ..... 2012-011419

(51) Int. Cl.
*G03G 15/08* (2006.01)

(52) U.S. Cl.
CPC ..... *G03G 15/0832* (2013.01); *G03G 15/0818* (2013.01); *G03G 15/0893* (2013.01); *G03G 15/0844* (2013.01); *G03G 15/0865* (2013.01)

(58) Field of Classification Search
USPC ..... 399/119, 281–284, 286, 287
See application file for complete search history.

(56) References Cited

U.S. PATENT DOCUMENTS

| | | | | |
|---|---|---|---|---|
| 4,407,228 | A | 10/1983 | Takano et al. | |
| 2010/0098447 | A1 | 4/2010 | Ootsuka | |
| 2010/0215401 | A1 * | 8/2010 | Fujiwara et al. | 399/119 |
| 2010/0232842 | A1 * | 9/2010 | Jung et al. | 399/287 |

FOREIGN PATENT DOCUMENTS

| | | | |
|---|---|---|---|
| JP | SHO 57-64266 | A | 4/1982 |
| JP | SHO 57-108870 | A | 7/1982 |
| JP | SHO 58-57156 | A | 4/1983 |
| JP | SHO 58-58568 | A | 4/1983 |
| JP | HEI 10-260571 | A | 9/1998 |
| JP | HEI 10-260572 | A | 9/1998 |
| JP | 2003-241510 | A | 8/2003 |
| JP | 2010-101980 | A | 5/2010 |
| JP | 2010-276720 | A | 12/2010 |

* cited by examiner

*Primary Examiner* — Hoang Ngo
(74) *Attorney, Agent, or Firm* — Scully, Scott, Murphy & Presser, PC

(57) ABSTRACT

A developer supply device configured to supply developer is provided. The developer supply device includes a rotatable developer carrying body configured to carry the developer, a casing configured to rotatably support the developer carrying body, and a restricting member configured to contact the developer carrying body to remove a part of the developer. The casing has a collecting side developer storage room configured to store the developer removed by the restricting member and a supplying side developer storage room configured to store the developer to be supplied to the brush layer. A supplying side developer storage level, which is a storage level of the developer in the supplying side developer storage room, is higher than a collecting side developer storage level, which is a storage level of the developer in the collecting side developer storage room.

9 Claims, 2 Drawing Sheets

DEVELOPER SUPPLY DEVICE

CROSS-REFERENCE TO RELATED APPLICATION

This application claims priority under 35 U.S.C. §119 from Japanese Patent Applications No. 2012-011419 filed on Jan. 23, 2012. The entire subject matter of the application is incorporated herein by reference.

BACKGROUND

1. Technical Field

The following description relates to a developer supply device configured to supply developer (e.g., dry-type developer: more specifically, a non-magnetic monocomponent dry-type developer) to an intended object.

2. Related Art

A developer supply device including a so-called "brush roller" used as a developer carrying body (i.e., a development roller) has been known.

SUMMARY

Aspects of the present invention are advantageous to provide a developer supply device including a brush roller used as a developer carrying body which is capable of carrying a developer in a favorable manner.

According to aspects of the present invention, a developer supply device configured to supply developer is provided. The developer supply device includes a rotatable developer carrying body including a roller body having a circumferential surface and a brush layer formed on the circumferential surface and configured to carry the developer, a casing having an opening extending along an rotation axis of the developer carrying body and configured to rotatably support the developer carrying body, and a restricting member fixed to the casing and configured to contact the brush layer to remove a part of the developer carried by the brush layer so as to restrict an amount of the developer carried by the developer carrying body. Additionally, the casing has a collecting side developer storage room configured to store the developer removed by the restricting member, and a supplying side developer storage room configured to store the developer to be supplied to the brush layer. The supplying side developer storage room is different from the collecting side developer storage room. Further, a supplying side developer storage level, which is a storage level of the developer in the supplying side developer storage room, is higher than a collecting side developer storage level, which is a storage level of the developer in the collecting side developer storage room.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the invention will be described with reference to the accompany drawings. It is noted that modifications for the embodiment will be described at ending so as to avoid misunderstanding of the embodiment.

<Configuration>

Figure 1:
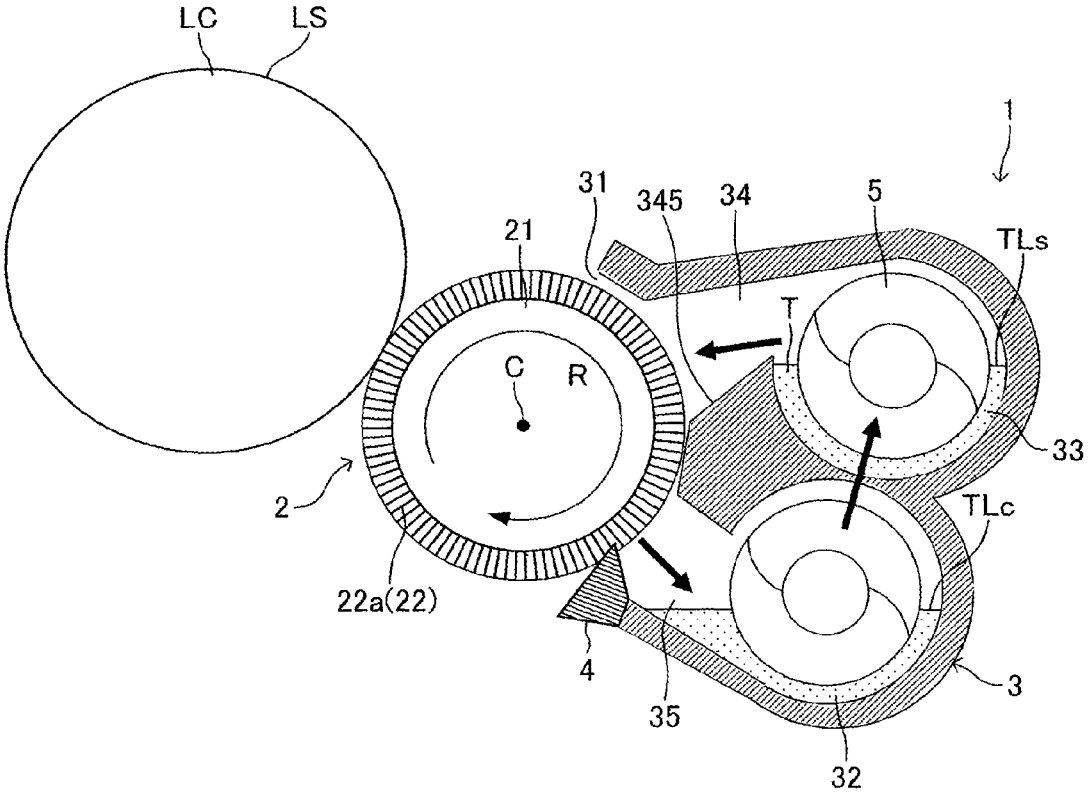
FIG. 1 is a cross-sectional side view schematically showing a configuration of a toner supply device in an embodiment according to one or more aspects of the present invention.
Figure 1:
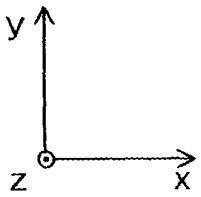
Figure 2:
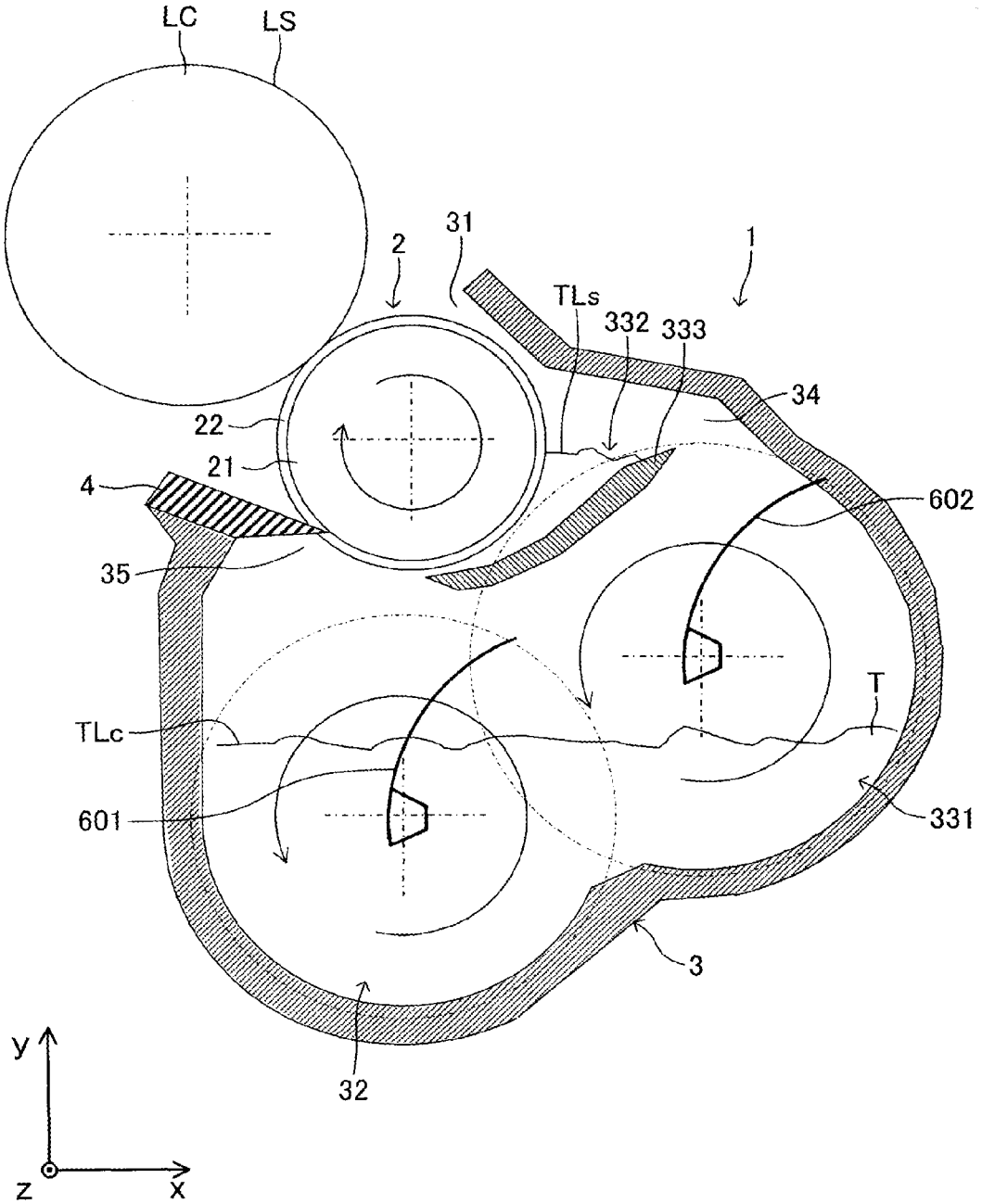
FIG. 2 is a cross-sectional side view schematically showing a configuration of a modification of the toner supply device shown in FIG. 1.

It is noted that y-axis shown in FIGS. 1 and 2 indicates a "vertical direction" that is parallel to a direction of gravitational force. Additionally, a positive direction of the y-axis indicates "upside" in the vertical direction. Further, a thick arrow in FIG. 1 indicates a migration/circulation of toner T.

A toner supply device 1 is configured to supply the toner T onto a circumferential surface (an electrostatic latent image carrying surface) LS, on which an electrostatic latent image is formed, of a photoconductive member such as a photoconductive drum LC. The toner T is non-magnetic monocomponent dry-type developer. The toner supply device 1 includes a development roller 2, a casing 3, a restricting member 4 and agitating augers 5.

The development roller 2 is a rotating member disposed to the casing 3 to rotate about a central axis C in a predetermined rotating direction R (i.e., a clockwise direction in FIG. 1). The development roller 2 is a so-called "brush roller" which has a well-known configurations. Specifically, the development roller 2 includes a roller body 21 having a circumferential surface, and a brush layer 22 having a plurality of fibrous members 22*a* attached on the circumferential surface of the roller body 21. The toner T is carried by the brush layer 22.

The casing 3 is a box member extending along the central axis C of the development roller 2 and stores the toner T in its inner space. On the casing 3, an opening 31 extending along the central axis C is formed. In the embodiment, the opening 31 is formed on a lateral side of the casing 3 and defined by a lower edge and an upper edge, which are parts of the casing 3. The casing 3 rotatably supports the development roller 2. The brush layer 22 is disposed at the opening 31 so as to face the photoconductive drum LC.

The restricting member 4 is fixed on the lower edge. The restricting member 4 is disposed to contact the brush layer 22 from below to remove a part of the toner T carried by the brush layer 22, and thereby restricting an amount of the toner T carried by the brush layer 22.

Inside the casing 3, a collecting side toner storage room 32 and a supplying side toner storage room 33 are formed. The collecting side toner storage room 32 is a space for storing the toner T that is removed by the restricting member 4. The supplying side toner storage room 33 is a space, which is different from the collecting side toner storage room 32, for storing the toner T that is to be supplied to the brush layer 22. The supplying side toner storage room 33 is located above the collecting side toner storage room 32.

In the embodiment, the collecting side toner storage room 32 is disposed obliquely below a position where the restricting member 4 contacts the brush layer 22. Thus, the collecting side toner storage room 32 is disposed so that the position where the restricting member 4 contacts the brush layer 22 is located above a storage level of the toner T in the collecting side toner storage room 32 (hereinafter, referred to as "a collecting side toner storage level TLc").

Additionally, in the embodiment, the supplying side toner storage room 33 is disposed lateral to the central axis C so that the toner T is supplied to the brush layer 22 by gravity (i.e., by the toner T's own weight). For this purpose, the supplying side toner storage room 33 is disposed such that a storage level of the toner T in the collecting side toner storage room 32 (hereinafter referred to as "a supplying side toner level TLs") is higher than the collecting side toner level TLc.

Further, on the casing 3, a toner supplying passage 34 and a toner collecting passage 35 are formed. The toner supplying passage 34 extends along the central axis C to allow the opening 31 to communicate with the supplying side toner storage room 33. The toner T stored in the supplying side toner storage room 33 is supplied to the development roller 2 through the toner supplying passage 34. The toner collecting passage 35 extends along the central axis C to allow the opening 31 to communicate with the collecting side toner storage room 32. The toner T removed by the restricting member 4 is fallen into the collecting side toner storage room 32 through the toner collecting passage 35. The toner supplying passage 34 is disposed above the toner collecting passage 35. Further, as shown in FIG. 1, a lower side face 345 of the toner supplying passage 34 is formed to slant downward to the development roller 2 so that the toner T stored in the supplying side toner storage room 33 slips over the lower side face 345 of the toner supplying passage 34 by gravity and is supplied to the brush layer 22.

The agitating augers 5 are accommodated in the collecting side toner storage room 32 and the supplying side toner storage room 33, respectively. The agitating augers 5 convey the toner T from the collecting side toner storage room 32 to the supplying side toner storage room 33 while agitating the same. As an example, the toner T may be conveyed to the supplying side toner storage room 33 as a pressure is applied to the toner T which is conveyed on the longitudinal sides of the agitating auger 5 in the collecting side toner storage room 33. As another example, scrapers (unshown) may be disposed on longitudinal end sides of the agitating auger 5 in the collecting side toner storage room 32, and the toner T is conveyed from the collecting side toner storage room 32 to the supplying side toner storage room 33 by the scrapers.

According to the toner supply device 1 in the embodiment, the toner T stored in the supplying side toner storage room 33, which is disposed obliquely above in the toner supply device 1, is supplied to the brush layer 22 of the development roller 2 by gravity while being well agitated by the agitating augers 5. Thus, the toner T is well carried by the brush layer 22 temporarily. Then, a part of the toner T temporarily carried by the brush layer 22 is removed by the restricting member 4. The toner removed from the brush layer 22 by the restricting member 4 is accumulated in the collecting side toner storage room 32.

In this regard, the supplying side toner storage room 33 (i.e., the supplying side toner storage level TLs) is located above the collecting side toner storage room 32 (i.e., the collecting side toner storage level TLc) in the embodiment. The supplying side toner storage room 33 may easily be arranged obliquely above in the toner supply device 1. Thus, the toner T stored in the supplying side toner storage room 33 can easily be supplied to the brush layer 22 by gravity (i.e., by the toner T's own weight). Additionally, the toner T removed by the restricting member 4 can be prevented from being carried by the brush layer 22 again, immediately after it is removed.

Further, in the embodiment, the collecting side toner storage room 32 and the collecting side toner storage level TLc are below the position where the restricting member 4 contacts the brush layer 22. Therefore, the toner T removed by the restricting member 4 can easily be accumulated in the collecting side toner storage room 32 by gravity. Thus, the toner T removed by the restricting member 4 can be further prevented from being carried by the brush layer 22 again, immediately after it is removed.

The toner T accumulated in the collecting side toner storage room 32 is conveyed to the supplying side toner storage room 33 while being agitated by the agitating augers 5. Thus, a circulation of the toner T in the toner supply device 1 (i.e., in the casing 3), or reuse of the toner T accumulated in the collecting side toner storage room 32 is well performed.

As described above, according to the toner supply device 1 of the embodiment, the toner T can be carried well by the development roller 2 (i.e., so-called brush roller) in comparison with the conventional techniques.

<Examples of Modifications>

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and a few examples of their versatility are shown and described in the present disclosure. It is to be understood that the present invention is capable of use in various other combinations and environments and is capable of changes or modifications within the scope of the inventive concept as expressed herein. For example, the following modifications are possible. In the following modifications, the same reference numbers are put to components having the same functions as the above described embodiment.

The intended object to which the developer is supplied, is not limited to the photoconductive drum. Aspects of the present invention may apply to a photoconductive body formed in a shape of a plate or an endless belt. Furthermore, aspects of the present invention may be applied to image forming apparatuses employing methods (such as a toner-jet method, an ion flow method, and a multi-stylus electrode method using no photoconductive body) other than the aforementioned electrophotographic method. In this case, image forming media such as papers, aperture electrodes or the like would be the intended object.

Additionally, an exemplary modification will be described with reference to FIG. 2. As shown FIG. 2, the opening 31 may be formed to open substantially upward in the modification.

Further, in the modification, the collecting side toner storage room 32, an intermediate toner storage room 331, and a roller side toner storage room 332 are formed inside the casing 3.

The collecting side toner storage room 32 is disposed at the lowest part of the casing 3 similarly to the above described embodiment. The intermediate toner storage room 331 is disposed obliquely above the collecting side toner storage room 32 and obliquely below the roller side toner storage room 332.

The roller side toner storage room 332 is disposed between the development roller 2 and the intermediate toner storage room 331. Specifically, the roller side toner storage room 332 is disposed adjacent to and obliquely below the development roller 2. Inside the casing 3, a dividing wall 333 which divides the intermediate toner storage room 331 and the roller side toner storage room 332 is formed. Thus, the roller side toner storage room 332 is formed on the dividing wall 333 for storing the toner T. In the modification, the brush layer 22 is immersed in the toner T stored in the roller side toner storage room 332.

The toner supplying passage 34 is formed between the intermediate toner storage room 331 side edge of the dividing wall 333 and an inner wall of the casing 3. In the modification, the toner supplying passage 34 is formed to allow the intermediate toner storage room 331 to communicate with the roller side toner storage room 332. Additionally, the toner collecting passage 35 is formed between the roller side toner storage room 332 side edge of the dividing wall 333 and the inner wall of the casing 3.

A collecting side agitator 601 is accommodated in the collecting side toner storage room 32, and a supplying side agitator 602 is accommodated in the intermediate toner storage room 331. The collecting side agitator 601 conveys the toner T stored in the collecting side toner storage room 32 to the intermediate toner storage room 331 while agitating the same. The supplying side agitator 602 conveys the toner T stored in the intermediate toner storage room 331 to the roller side toner storage room 332 while agitating the same.

According to the modification, the brush layer 22 is immersed in the toner T stored in the roller side toner storage room 332 so that the toner T is temporarily carried by the brush layer 22. Then, a part of the toner T carried by the brush layer 22 is removed by the restricting member 4 and accumulated in the underlying collecting side toner storage room 32 through the toner collecting passage 35.

The toner T stored in the collecting side toner storage room 32 is conveyed to the intermediate toner storage room 331 while favorably fluidizing by the agitation with the collecting side agitator 601. The toner T stored in the intermediate toner storage room 331 is conveyed to the roller side toner storage room 332 while favorably fluidizing by the agitation with the supplying side agitator 602.

As described above, according to the modification, the toner T can be carried by the development roller 2 (i.e., so-called brush roller) in comparison with the conventional techniques.

What is claimed is:

1. A developer supply device configured to supply developer, the developer supply device comprising:

a rotatable developer carrying body comprising:

a roller body having a circumferential surface; and a brush layer formed on the circumferential surface and configured to carry the developer;

a casing having an opening extending along a rotation axis of the rotatable developer carrying body, the casing being configured to rotatably support the rotatable developer carrying body; and a restricting member configured to contact the brush layer to remove a part of the developer carried by the brush layer so as to restrict an amount of the developer carried by the the brush layer, the restricting member being fixed to the casing, wherein the casing has:

a collecting side developer storage room configured to store the developer removed by the restricting member; and a supplying side developer storage room configured to store the developer to be supplied to the brush layer, the supplying side developer storage room is different from the collecting side developer storage room, wherein a supplying side developer storage level, which is a storage level of the developer in the supplying side developer storage room, is higher than a collecting side developer storage level, which is a storage level of the developer in the collecting side developer storage room, wherein the supplying side developer storage room is disposed on an upstream side with respect to the collecting side developer storage room in a rotation direction of the rotatable developer carrying body, and wherein the restriction member is disposed on a downstream side with respect to the collecting side developer storage room in the rotation direction of the rotatable developer carrying body.

2. The developer supply device according to claim 1, wherein the casing has:

a developer supplying passage extending along the rotation axis configured to allow the supplying side developer storage room to communicate with the opening to supply the developer from the supplying side developer storage room to the rotatable developer carrying body; and a developer collecting passage extending along the rotation axis configured to allow the collecting side developer storage room to communicate with the opening to allow the developer removed by the restricting member to be accumulated in the collecting side developer storage room, and wherein the developer supplying passage is disposed above the developer collecting passage.

3. The developer supply device according to claim 1, wherein the restricting member is disposed to contact the brush layer from below.

4. The developer supply device according to claim 1, wherein a position where the restricting member contacts the brush layer is above the collecting side developer storage level.

5. The developer supply device according to claim 1, further comprising a circulating unit configured to convey the developer from the collecting side developer storage room to the supplying side developer storage room.

6. The developer supply device according to claim 1, wherein the casing has an intermediate developer storage room disposed between the collecting side developer storage room and the supplying side developer storage room.

7. The developer supply device according to claim 6, wherein the casing comprises a dividing wall configured to divide the supplying side developer storage room from the intermediate developer storage room, wherein the supplying side developer storage room is formed on the dividing wall.

8. The developer supply device according to claim 6, further comprising:

a first agitator configured to agitate the developer stored in the collecting side developer storage room; and a second agitator configured to agitate the developer stored in the intermediate developer storage room.

9. The developer supply device according to claim 8, wherein the first agitator is configured to convey the developer from the collecting side developer storage room to the intermediate developer storage room, and the second agitator is configured to convey the developer from the intermediate developer storage room to the supplying side developer storage room.

* * * * *